US008573938B1

(12) United States Patent
Liang

(10) Patent No.: US 8,573,938 B1
(45) Date of Patent: Nov. 5, 2013

(54) TURBINE VANE WITH ENDWALL FILM COOLING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 555 days.

(21) Appl. No.: 12/951,551

(22) Filed: Nov. 22, 2010

(51) Int. Cl.
*F01D 5/08* (2006.01)
*F01D 5/18* (2006.01)

(52) U.S. Cl.
USPC ..... 416/95; 416/96 R; 416/97 R; 415/115; 60/752; 60/806

(58) Field of Classification Search
USPC ..... 415/115, 116; 416/95, 96 R, 96 A, 97 R, 416/97 A; 60/752, 806
See application file for complete search history.

(56) References Cited

U.S. PATENT DOCUMENTS

| | | | | |
|---|---|---|---|---|
| 4,726,735 | A * | 2/1988 | Field et al. | 416/97 R |
| 5,417,545 | A * | 5/1995 | Harrogate | 415/115 |
| 5,419,681 | A * | 5/1995 | Lee | 416/97 R |
| 5,470,198 | A * | 11/1995 | Harrogate et al. | 415/115 |
| 7,766,618 | B1 * | 8/2010 | Liang | 416/97 R |
| 7,857,580 | B1 * | 12/2010 | Liang | 415/115 |

* cited by examiner

*Primary Examiner* — Igor Kershteyn
(74) *Attorney, Agent, or Firm* — John Ryznic

(57) ABSTRACT

A turbine stator vane with endwall cooling that includes a row of submerged cooling air channels or slots that include a metering hole at an inlet end, a diffusion chamber downstream from the metering hole, and an open slot that channels and discharges the cooling air from the slots as film cooling air for the endwalls. Each submerged cooling air slot can be customized for pressure and flow to control metal temperature and cooling capability.

5 Claims, 3 Drawing Sheets

TURBINE VANE WITH ENDWALL FILM COOLING

GOVERNMENT LICENSE RIGHTS

None.

CROSS-REFERENCE TO RELATED APPLICATIONS

None.

BACKGROUND OF THE INVENTION

1. Field of the Invention

The present invention relates generally to a gas turbine engine, and more specifically to a turbine stator vane with film cooling.

2. Description of the Related Art including information disclosed under 37 CFR 1.97 and 1.98

In a gas turbine engine, such as a large frame heavy-duty industrial gas turbine (IGT) engine, a hot gas stream generated in a combustor is passed through a turbine to produce mechanical work. The turbine includes one or more rows or stages of stator vanes and rotor blades that react with the hot gas stream in a progressively decreasing temperature. The efficiency of the turbine—and therefore the engine—can be increased by passing a higher temperature gas stream into the turbine. However, the turbine inlet temperature is limited to the material properties of the turbine, especially the first stage vanes and blades, and an amount of cooling capability for these first stage airfoils.

The first stage rotor blade and stator vanes are exposed to the highest gas stream temperatures, with the temperature gradually decreasing as the gas stream passes through the turbine stages. The first and second stage airfoils (blades and vanes) must be cooled by passing cooling air through internal cooling passages and discharging the cooling air through film cooling holes to provide a blanket layer of cooling air to protect the hot metal surface from the hot gas stream.

A turbine airfoil—whether a rotor blade or a stator vane—is exposed to different temperatures and pressures from the hot gas stream. Not all areas of the airfoil are adequately cooled, and thus hot spots appear. Hot spots on the airfoils will cause erosion or corrosion damage in which material is lost and holes form. This significantly reduces the useful life of the airfoil. This is especially important for the large frame industrial gas turbine engine used for electric power production because these engines must run for very long periods of time.

A prior art vane is shown in FIG. 1 and includes inner and outer endwalls 12 with the airfoil 11 extending between the endwalls. The vane endwall 12 is cooled using two rows of circular or shaped film cooling holes 13 and 14 located on the upstream side of the endwall. In this cooling design, streamwise and circumferential cooling flow control is difficult to achieve due to the airfoil external hot gas temperature and pressure variations. Film cooling air discharged from the two rows of film cooling holes 13 and 14 have a tendency to migrate from the pressure side toward the vane suction side surface which will induce a mal-distribution of the film cooling flow and endwall metal temperature.

BRIEF SUMMARY OF THE INVENTION

A turbine stator vane with film cooling for the endwalls, where the endwall includes a row of multiple metering and diffusion submerged cooling channels extending across the endwall for the vane endwall leading edge region. Each submerged channel is supplied with cooling air from a metering and impingement hole. Each submerged channel opens onto the endwall surface downstream from the metering and impingement holes to discharge film cooling air from each channel. The submerged channels form diffusion exit channels so that metering and impingement and diffusion of the cooling air occurs in each channel. Each individual module can be designed based on the airfoil local external heat load to achieve a desired local metal temperature.

DETAILED DESCRIPTION OF THE INVENTION

Figure 1:
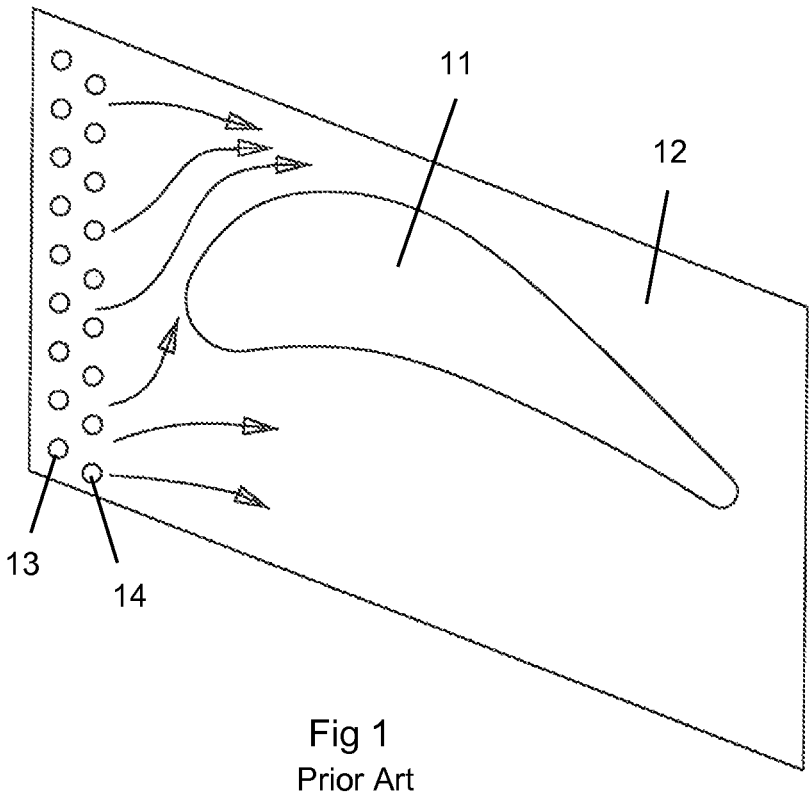
Fig 1 Prior Art
FIG. 1 shows a stator vane of the prior art with an endwall cooling circuit formed from two rows of film cooling holes.
Figure 2:
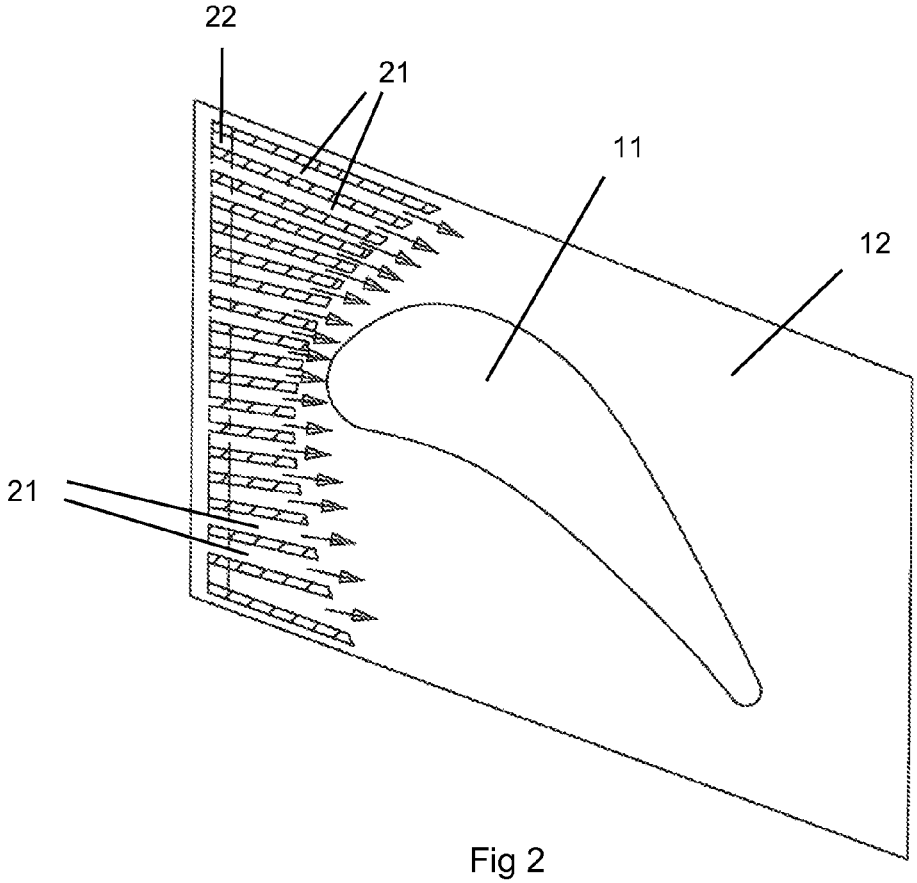
FIG. 2 shows a top view of a stator vane endwall cooling circuit of the present invention.
Figure 3:
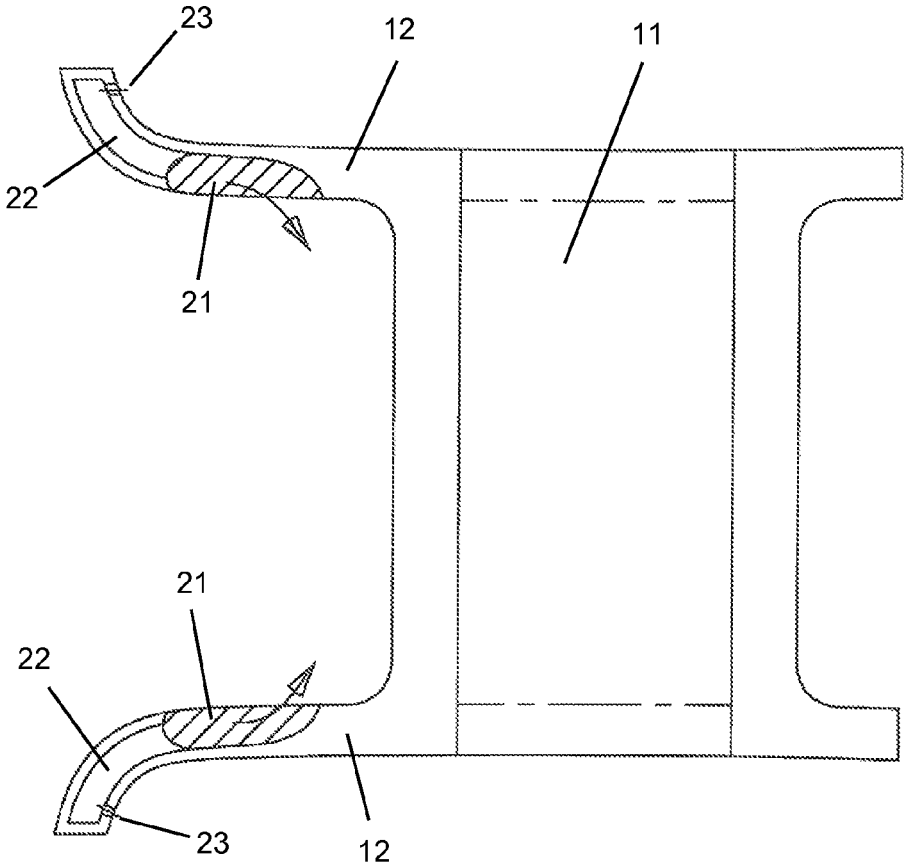
FIG. 3 shows a cross section side view of the vane endwall cooling circuit of the present invention.

A turbine stator vane with endwall cooling is shown in FIGS. 2 and 3. The vane includes an airfoil extending between an inner diameter endwall and an outer diameter endwall. Both endwalls can have the endwall cooling circuit of the present invention. The vane includes an airfoil extending out from an endwall 12. A row of submerged slots or cooling channels 21 are formed on the leading edge side of the endwall and extend toward the aft side of the endwall.

FIG. 3 shows a side view of the submerged slot 21 formed within the endwall. The slot 21 includes a diffusion chamber 22 at an inlet end connected to a metering hole 23 to supply cooling air to the slot 21. The downstream (in the hot gas flow) end of the submerged slot 21 is open onto the hot surface side of the endwall 12 so that the cooling air is discharged as film cooling air. Both the inner endwall and the outer endwall have the submerged slots 21. The slots 21 extend from the pressure side edge of the endwall 12 to the suction side edge to cover the entire leading edge side of the endwall. The slots are submerged in that the openings are formed by sides of the slot that have tops flush with the endwall outer surface.

The submerged cooling slots or channels 21 include a metering hole at an inlet end to meter the cooling air flow and to produce impingement and then diffusion of the cooling air within the slot 21. The multiple metering and diffusion cooling slot is constructed in small modular formation. Individual modules are designed based on the airfoil gas side pressure distribution in both the streamwise and circumferential directions. In addition, each individual module can be designed based on the airfoil local external heat load to achieve a desired local metal temperature. The individual small modules can be constructed in a parallel or a non-parallel array along the endwall leading edge section. With the submerged slot cooling channels of the present invention, a maximum use of cooling air for a given airfoil inlet gas temperature and pressure profile can be achieved.

In operation, cooling air is provided by the vane cooling air supply manifold and is metered at the entrance section of the submerged cooling slot to closely match the hot gas flow condition prior to being discharged from the submerged slot. The film cooling exit slot is submerged from the airfoil surface in the multiple slots on the forward region of the endwall to provide proper cooling flow spacing for the discharged cooling air to minimize any shear mixing between the discharged film cooling air and the hot gas flow which will enhance the cooling effectiveness for the endwall leading edge side. The multiple slots on the forward region of the vane endwall will retain the cooling air within the slot longer. In addition, the multiple slots also reduce the hot gas side heat load surface and increase the cool side surface. Since the cooling air is metered and diffused in the long submerged slot, the cooling air is distributed uniformly within the film cooling channels which reduce the film cooling air exit momentum. Coolant penetration into the hot gas path is therefore minimized, yielding a good build up of the coolant sub-boundary layer next to the endwall leading edge surface for a better film coverage in the streamwise and circumferential directions of the endwall leading edge region.

In addition, the exit portion of the multiple metering and diffusion submerged cooling slots is constructed with multiple flow surfaces in order to generate additional convection are for the endwall leading edge region. The combination effects of additional convection cooling plus the multiple diffusion film cooling at very high film coverage yields a very high cooling effectiveness and a uniform wall temperature for the vane endwall leading edge region.

I claim the following:

1. A turbine stator vane comprising:

an airfoil extending between an inner endwall and an outer endwall;

the inner endwall and the outer endwall each having a leading edge section;

a submerged cooling air slot formed within the leading edge section of the two endwalls and extending toward a trailing edge side of the endwalls;

the submerged cooling air slot having a metering hole on an inlet end, a diffusion chamber downstream from the metering hole, and an exit opening onto the endwall surface downstream from the diffusion chamber;

the diffusion chamber is formed in an outward curving section of the endwall; and, the metering hole is directed to discharge cooling air to impinge against a hot side of the diffusion chamber.

2. The turbine stator vane of claim 1, and further comprising:

a row of submerged cooling air slots extending from a pressure side to a suction side of the endwalls.

3. The turbine stator vane of claim 2, and further comprising:

the row of submerged cooling air slots ends around a leading edge of the airfoil.

4. The turbine stator vane of claim 1, and further comprising:

a length of the diffusion chamber is about equal to the length of the exit opening of the submerged cooling air slot.

5. The turbine stator vane of claim 2, and further comprising:

the submerged cooling air slots are separate cooling air slots such that individual pressure and flow can be produced.

* * * * *